US009312590B2

(12) United States Patent
Kato et al.

(10) Patent No.: US 9,312,590 B2
(45) Date of Patent: Apr. 12, 2016

(54) HIGH-FREQUENCY SIGNAL TRANSMISSION LINE AND ELECTRONIC DEVICE

(71) Applicant: Murata Manufacturing Co., Ltd., Nagaokakyo-shi, Kyoto-fu (JP)

(72) Inventors: Noboru Kato, Nagaokakyo (JP); Masahiro Ozawa, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 220 days.

(21) Appl. No.: 14/193,070

(22) Filed: Feb. 28, 2014

(65) Prior Publication Data

US 2014/0176265 A1 Jun. 26, 2014

Related U.S. Application Data

(63) Continuation of application No. PCT/JP2012/082196, filed on Dec. 12, 2012.

(30) Foreign Application Priority Data

Jan. 6, 2012 (JP) ..... 2012-000988
Oct. 1, 2012 (JP) ..... 2012-219131

(51) Int. Cl.
*H01P 3/08* (2006.01)
*H01P 1/203* (2006.01)

(52) U.S. Cl.
CPC ..... *H01P 3/088* (2013.01); *H01P 3/085* (2013.01); *H01P 1/20363* (2013.01)

(58) Field of Classification Search
CPC ..... H01P 3/08; H03H 7/38
USPC ..... 333/1, 4, 5, 238, 246, 33
See application file for complete search history.

(56) References Cited

U.S. PATENT DOCUMENTS

2012/0274423 A1 11/2012 Kato
2014/0048312 A1 2/2014 Kato et al.
2014/0176266 A1 6/2014 Kato et al.

FOREIGN PATENT DOCUMENTS

CN 102687600 A 9/2012
CN 103733425 A 4/2014
JP 5-343564 A 12/1993
WO 2011/007660 A1 1/2011

OTHER PUBLICATIONS

Official Communication issued in International Patent Application No. PCT/JP2012/082196, mailed on Mar. 26, 2013.

*Primary Examiner* — Stephen E Jones
(74) *Attorney, Agent, or Firm* — Keating & Bennett, LLP

(57) ABSTRACT

A high-frequency signal transmission line includes a dielectric body including a stack of a plurality of dielectric layers, a linear signal line located in the dielectric body, a first ground conductor located at a first side of the signal line in a stacking direction and including a plurality of first openings arranged along the signal line, and a plurality of floating conductors located at the first side of the signal line in the stacking direction to overlap with the first openings, when viewed from the stacking direction, each of the floating conductors being not connected to any other conductors.

20 Claims, 12 Drawing Sheets

HIGH-FREQUENCY SIGNAL TRANSMISSION LINE AND ELECTRONIC DEVICE

BACKGROUND OF THE INVENTION

1. Field of the Invention

The present invention relates to a high-frequency transmission signal line and an electronic device, and more particularly to a high-frequency signal transmission line that transmits a high-frequency signal, and an electronic device.

2. Description of the Related Art

As a conventional high-frequency transmission signal line, for example, a signal transmission line disclosed by WO2011/007660 is known. The signal transmission line includes a laminate body, a signal line and two ground conductors. The laminate body is formed by stacking a plurality of insulating sheets. The signal line is disposed in the laminate body. The two ground conductors are disposed in the laminate body so as to sandwich the signal line with respect to the stacking direction. Thus, the signal line and the ground conductors form a strip-line structure.

The ground conductors have a plurality of openings in positions so as to overlap with the signal line, when viewed from the stacking direction. In positions where the plurality of openings are located, the capacitance generated among the signal line and the ground conductors is small. Accordingly, it is possible to shorten the distances in the stacking direction among the signal lines and the respective ground conductors without setting the characteristic impedance too low. Consequently, it becomes possible to produce a thinner high-frequency signal transmission line. Such a high-frequency signal transmission line is used, for example, to connect two circuit boards to each other.

In the high-frequency signal transmission line disclosed in WO2011/007660, however, since the ground conductors have openings, electromagnetic waves leak through the openings. Therefore, unnecessary radiation from the signal transmission line to the surrounding electronic devices occurs. When the signal transmission line is attached to a metal object such as a battery pack, the signal line and the battery pack are electromagnetically coupled via the openings. Consequently, the characteristic impedance of the signal line varies from the designed value.

SUMMARY OF THE INVENTION

Preferred embodiments of the present invention provide a high-frequency signal transmission line which inhibits electromagnetic wave leakage through openings of a ground conductor, and an electronic device.

A high-frequency signal transmission line according to a preferred embodiment of the present invention includes a dielectric body including a plurality of dielectric layers stacked on each other; a linear signal line disposed in the dielectric body; a first ground conductor located at a side of the signal line in a stacking direction and including a plurality of first openings arranged along the signal line; and a plurality of floating conductors located over the first openings, when viewed from the stacking direction, and located at a side of the signal line in the stacking direction, each of the floating conductors being not connected to any other conductors.

An electronic device according to a preferred embodiment of the present invention includes a casing and a high-frequency signal transmission line. The high-frequency signal transmission line includes a dielectric body including a plurality of dielectric layers stacked on each other; a linear signal line disposed in the dielectric body; a first ground conductor located at a first side of the signal line in a stacking direction and including a plurality of first openings arranged along the signal line; and a plurality of floating conductors located at the first side of the signal line in the stacking direction to overlap with the first openings, when viewed from the stacking direction, each of the floating conductors being not connected to any other conductors.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A high-frequency signal transmission line and an electronic device according to preferred embodiments of the present invention will be hereinafter described with reference to the drawings.

Figure 1:
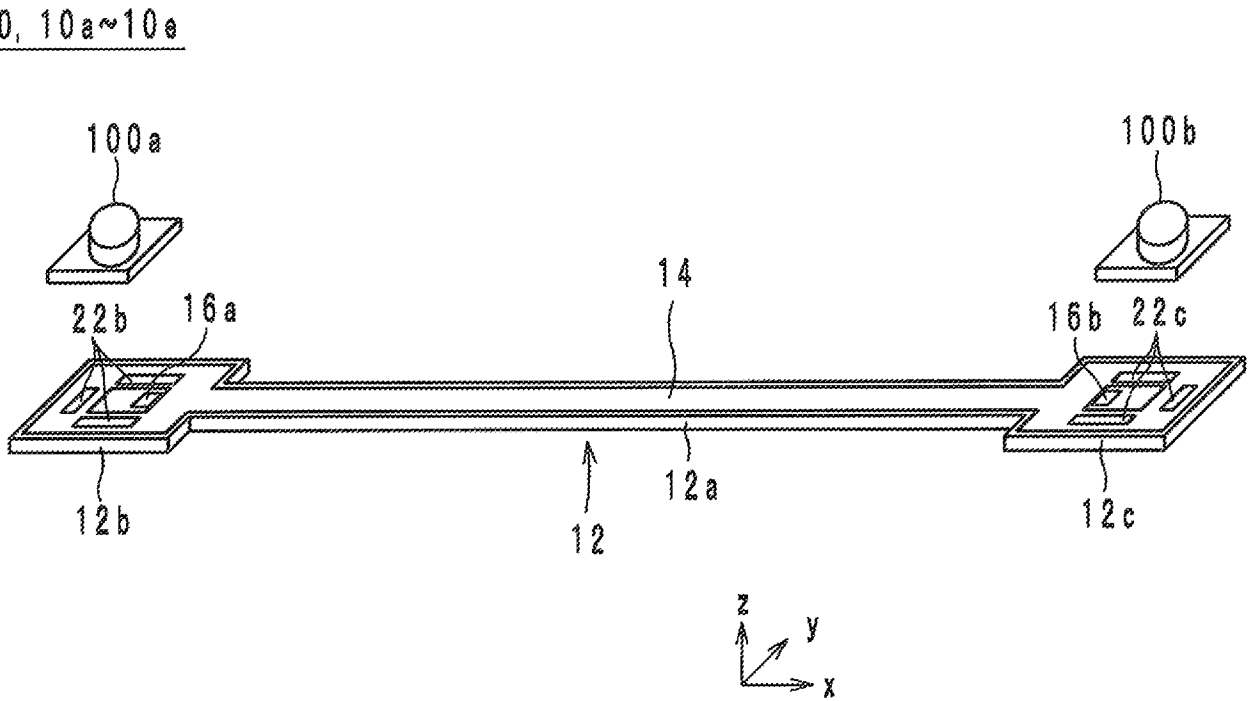
FIG. 1 is a perspective view of a high-frequency signal transmission line according to a preferred embodiment of the present invention.
Figure 2:
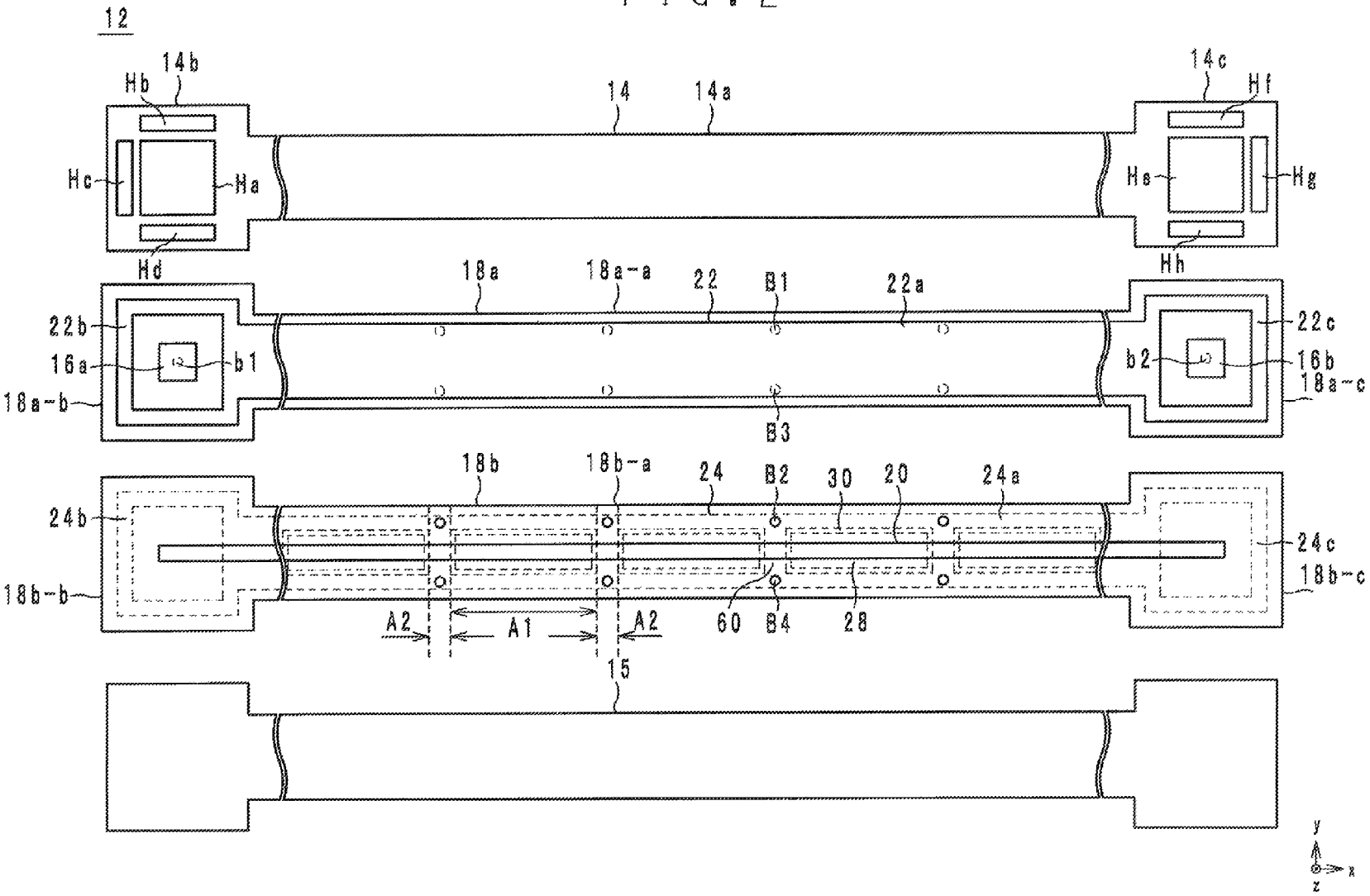
FIG. 2 is an exploded view of a dielectric body of the high-frequency signal transmission line shown by FIG. 1.
Figure 3:
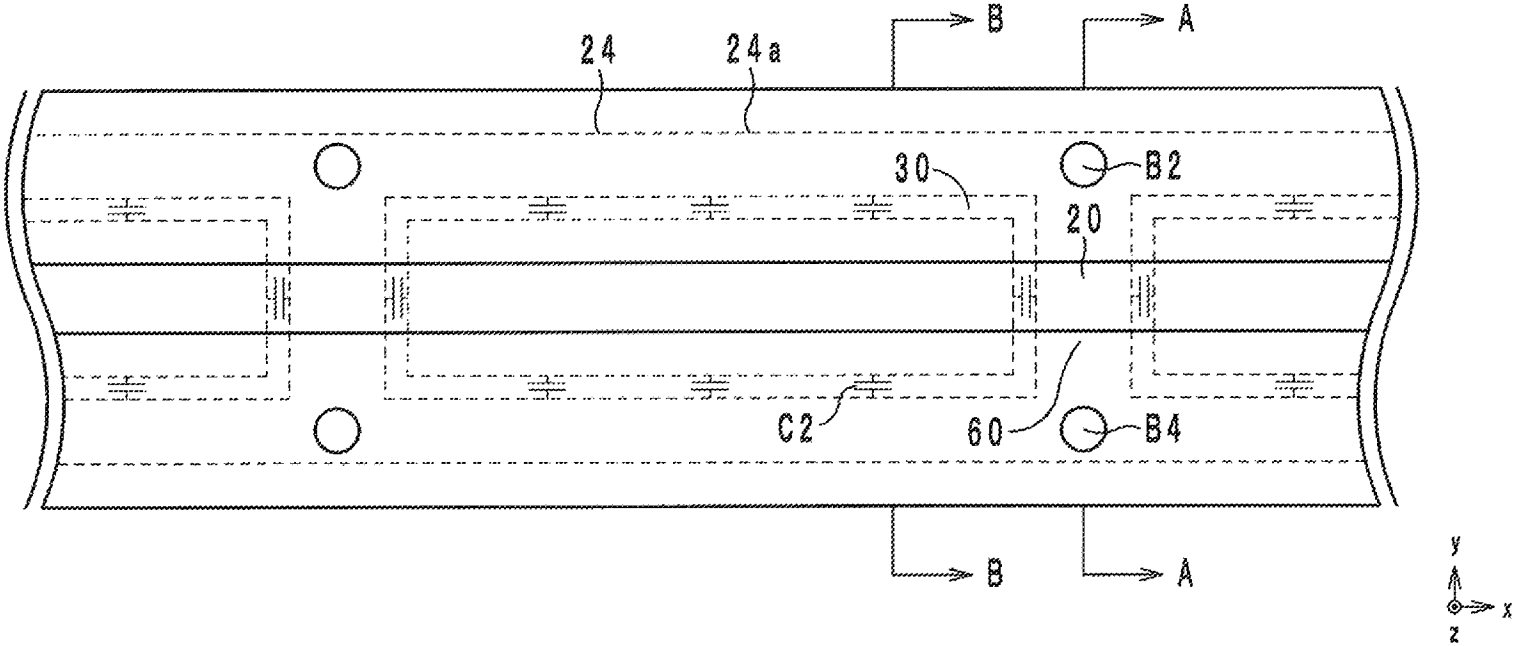
FIG. 3 is a transparent view of the high-frequency signal transmission line shown by FIG. 1, showing a signal line and an auxiliary ground conductor.
Figure 4:
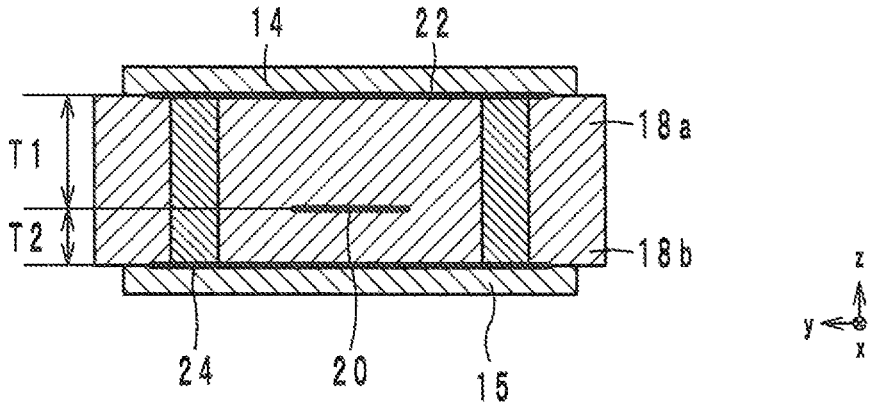
FIG. 4 is a sectional view taken along the line A-A shown in FIG. 3.
Figure 5:
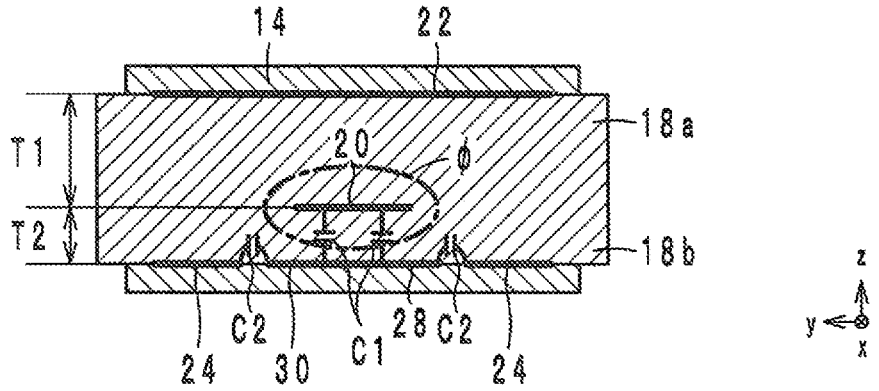
FIG. 5 is a sectional view taken along the line B-B shown in FIG. 3.

The structure of a high-frequency signal transmission line according to a preferred embodiment of the present invention will be described. FIG. 1 is a perspective view of a high-frequency signal transmission line 10 according to a preferred embodiment of the present invention. FIG. 2 is an exploded view of a dielectric body of the high-frequency signal transmission line 10. FIG. 3 is a transparent view of the high-frequency signal transmission line 10, showing a signal line 20 and an auxiliary ground conductor 24. FIG. 4 is a sectional view taken along the line A-A shown in FIG. 3. FIG. 5 is a sectional view taken along the line B-B shown in FIG. 3. A direction in which layers are stacked in the high-frequency signal transmission line 10 is hereinafter referred to as a z-axis direction. A lengthwise direction of the high-frequency signal transmission line 10 is hereafter referred to as an x-axis direction. A direction perpendicular to the x-axis direction and the z-axis direction is hereinafter referred to as a y-axis direction.

The high-frequency signal transmission line 10 is, for example, a flat cable that is to be disposed inside an electronic device such as a cellphone to connect two high-frequency circuits. As shown by FIGS. 1 and 2, the high-frequency signal transmission line 10 includes a dielectric body 12, external terminals 16*a* and 16*b*, a signal line 20, a main ground conductor (second ground conductor) 22, an auxiliary ground conductor (first ground conductor) 24, floating conductors 28, via-hole conductors (interlayer connections) b1, b2, B1 to B4, and connectors 100*a* and 100*b*.

As shown by FIG. 1, the dielectric body 12 is a flexible plate-shaped member extending in the x-axis direction when viewed from the z-axis direction. The dielectric body 12 includes a line portion 12*a*, and connector portions 12*b* and 12*c*. The dielectric body 12 is a laminate body including a protective layer 14, dielectric sheets 18*a* and 18*b*, and a protective layer 15 stacked in this order from a positive side to a negative side in the z-axis direction. In the following, a main surface of the dielectric body 12 located at the positive z-axis side is referred to as a front surface of the dielectric body 12, and a main surface of the dielectric body 12 located at the negative z-axis side is referred to as a back surface of the dielectric body 12.

The line portion 12*a*, as shown in FIG. 1, extends in the x-axis direction. The connector portions 12*b* and 12*c* preferably are rectangular or substantially rectangular and are located at a negative x-axis end and at a positive x-axis end of the line portion 12*a*, respectively. The sizes in the y-axis direction of the connector portions 12*b* and 12*c* are greater than the size in the y-axis direction of the line portion 12*a*.

The dielectric sheets 18*a* and 18*b*, as shown by FIG. 2, extend in the x-axis direction and are the same shape as the dielectric body 12, when viewed from the z-axis direction. The dielectric sheets 18*a* and 18*b* are sheets of flexible thermoplastic resin such as polyimide, liquid polymer or the like. In the following, a main surface of each of the dielectric sheets 18*a* and 18*b* located at the positive z-axis side is referred to as a front surface, and a main surface of each of the dielectric sheets 18*a* and 18*b* located at the negative z-axis side is referred to as a back surface.

As shown by FIGS. 4 and 5, the thickness T1 of the dielectric sheet 18*a* is greater than the thickness T2 of the dielectric sheet 18*b*. The thickness T1 after stacking of the dielectric sheets 18*a* and 18*b* preferably is, for example, within a range from about 50 μm to about 300 μm. In this preferred embodiment, the thickness T1 preferably is about 150 μm, for example. The thickness T2 preferably is, for example, within a range from about 10 μm to about 100 μm. In this preferred embodiment, the thickness T2 preferably is about 50 μm, for example.

As shown in FIG. 2, the dielectric sheet 18*a* includes a line portion 18*a-a*, and connector portions 18*a-b* and 18*a-c*. The dielectric sheet 18*b* includes a line portion 18*b-a*, and connector portions 18*b-b* and 18*b-c*. The line portions 18*a-a* and 18*b-a* define the line portion 12*a*. The connector portions 18*a-b* and 18*b-b* define the connector portion 12*b*. The connector portions 18*a-c* and 18*b-c* define the connector portion 12*c*.

The signal line 20 is, as shown in FIG. 2, a conductor provided in the dielectric body 12 so as to transmit a high-frequency signal. In this preferred embodiment, the signal line 20 is a linear conductor that is arranged on the front surface of the dielectric sheet 18*b* to extend in the x-axis direction. As shown in FIG. 2, the negative x-axis end of the signal line 20 is located in the center of the connector portion 18*b-b*. As shown in FIG. 2, the positive x-axis end of the signal line 20 is located in the center of the connector portion 18*b-c*. The signal line 20 is made of a metal material with a relatively small specific resistance, such as a silver-based material, a copper-based material or the like. The statement that the signal line 20 is arranged on the front surface of the dielectric sheet 18*b* indicates, for example, that the signal line 20 is preferably formed by plating of the front surface of the dielectric sheet 18*b* with a metal foil and by patterning of the metal foil or that the signal line 20 preferably is formed by sticking of a metal foil onto the front surface of the dielectric sheet 18*b* and by patterning of the metal foil. The surface of the signal line 20 is smoothened, and thus, the surface roughness of the signal line 20 on the surface in contact with the dielectric sheet 18*b* is greater than the surface roughness of the signal line 20 on the surface out of contact with the dielectric sheet 18*b*.

The main ground conductor 22 is, as shown in FIG. 2, a continuous conductor located at the positive z-axis side of the signal line 20. More specifically, the main ground conductor 22 is arranged on the front surface of the dielectric sheet 18*a* to be opposed to the signal line 20 via the dielectric sheet 18*a*. The main ground conductor 22 has no openings in an area overlapping with the signal line 20. The main ground conductor 22 is made of a metal material with a relatively small specific resistance, such as a silver-based material, a copper-based material or the like. The statement that the main ground conductor 22 is arranged on the front surface of the dielectric sheet 18*a* indicates, for example, that the main ground conductor 22 preferably is formed by plating of the front surface of the dielectric sheet 18*a* with a metal foil and by patterning of the metal foil or that the main ground conductor 22 preferably is formed by sticking of a metal foil onto the front surface of the dielectric sheet 18*a* and by patterning of the metal foil. The surface of the main ground conductor 22 is smoothened, and thus, the surface roughness of the main ground conductor 22 on the surface in contact with the dielectric sheet 18*a* is greater than the surface roughness of the main ground conductor 22 on the surface out of contact with the dielectric sheet 18*a*.

The main ground conductor 22, as shown in FIG. 2, includes a line portion 22*a*, and terminal portions 22*b* and 22*c*. The line portion 22*a* is located on the front surface of the line portion 18*a-a* to extend in the x-axis direction. The terminal portion 22*b* is located on the front surface of the connector portion 18*a-b* and is in the shape of a rectangular or substantially rectangular loop. The terminal portion 22*b* is connected to the negative x-axis end of the line portion 22*a*. The terminal portion 22*c* is located on the front surface of the connector portion 18*a-c* and is in the shape of a rectangular or substantially rectangular loop. The terminal portion 22*c* is connected to the positive x-axis end of the line portion 22*a*.

The characteristic impedance of the high-frequency signal transmission line 10 depends on mainly the area where the signal line 20 and the main ground conductor 22 are opposed to each other, the distance between the signal line 20 and the main ground conductor 22, and the relative permittivity of the dielectric sheets 18*a* and 18*b*. Therefore, when the high-frequency signal transmission line 10 is desired to have a characteristic impedance of 50Ω, for example, the signal line 20 and the main ground conductor 22 are designed to cause the high-frequency signal transmission line 10 to have a characteristic impedance of 55Ω, for example, which is a little higher than the desired value. Thereafter, the shape of the auxiliary ground conductor 24 is adjusted as described below such that the signal line 20, the main ground conductor 22 and the auxiliary ground conductor 24 cause the high-frequency signal transmission line 10 to have a characteristic impedance of 50Ω.

The auxiliary ground conductor 24 is, as shown in FIG. 2, located at the negative z-axis side of the signal line 20. The auxiliary ground conductor 24 includes a plurality of openings 30 arranged along the signal line 20. More specifically, the auxiliary ground conductor 24 is arranged on the back surface of the dielectric sheet 18*b* to be opposed to the signal line 20 via the dielectric sheet 18*b*. The auxiliary ground conductor 24 is made of a metal material with a relatively small specific resistance, such as a silver-based material, a copper-based material or the like. The statement that the auxiliary ground conductor 24 is arranged on the back surface of the dielectric sheet 18*b* means, for example, that the auxiliary ground conductor 24 preferably is formed by plating of the back surface of the dielectric sheet 18*b* with a metal foil and by patterning of the metal foil or that the auxiliary ground conductor 24 preferably is formed by sticking of a metal foil onto the back surface of the dielectric sheet 18*b* and by patterning of the metal foil. The surface of the auxiliary ground conductor 24 is smoothened, and thus, the surface roughness of the auxiliary ground conductor 24 on the surface in contact with the dielectric sheet 18*b* is greater than the surface roughness of the auxiliary ground conductor 24 on the surface out of contact with the dielectric sheet 18*b*.

The auxiliary ground conductor 24, as shown by FIG. 2, includes a line portion 24*a*, and terminal portions 24*b* and 24*c*. The line portion 24*a* is located on the back surface of the line portion 18*b-a* to extend in the x-axis direction. The terminal portion 24*b* is located on the back surface of the connector portion 18*b-b* and is in the shape of a rectangular or substantially rectangular loop. The terminal portion 24*b* is connected to the negative x-axis end of the line portion 24*a*. The terminal portion 24*c* is located on the back surface of the connector portion 18*b-c* and is in the shape of a rectangular or substantially rectangular loop. The terminal portion 24*c* is connected to the positive x-axis end of the line portion 24*a*.

As shown in FIG. 2, the line portion 24*a* includes a plurality of rectangular or substantially rectangular openings 30 arranged in a line along the x-axis. Accordingly, the line portion 24*a* preferably is in the shape of a ladder, for example. Portions of the auxiliary ground conductor 24 among the openings 30 are referred to as bridges 60. The respective bridges 60 extend in the y-axis direction. The plurality of openings 30 and the bridges 60 are arranged alternately along the signal line 20 to overlap with the signal line 20, when viewed from the z-axis direction. In this preferred embodiment, the signal line 20 extends in the x-axis direction while crossing the centers of the respective openings 30 and the respective bridges 60 with respect to the y-axis direction.

The auxiliary ground conductor 24 functions also as a shield. As mentioned above, the auxiliary ground conductor 24 is designed for final adjustment of the characteristic impedance such that the characteristic impedance of the high-frequency signal transmission line 10 will finally be about 50Ω, for example.

The floating conductors 28 overlap with the same positions as the respective openings 30, when viewed from the z-axis direction, and are located at the negative z-axis side of the signal line 20. In this preferred embodiment, the floating conductors 28 are arranged on the back surface of the dielectric sheet 18*b*, on which the auxiliary ground conductor 24 is located. The floating conductors 28 and the openings 30 are provided on a one-to-one basis.

The size in the x-axis direction (length) of the floating conductors 28 is a little smaller than the size in the x-axis direction (length) of the openings 30. Further, the size in the y-axis direction (width) of the floating conductors 28 is a little smaller than the size in the y-axis direction (width) of the openings 30. Each of the floating conductors 28 is located inside the corresponding opening 30 without contacting with the outer edge of the opening 30, when viewed from the z-axis direction. Accordingly, a narrow gap exists between each of the floating conductors 28 and the outer edge of the corresponding opening 30. Thus, each of the floating conductors 28 is not connected to any other conductors, and is maintained at a floating potential.

The floating conductors 28 overlap with the signal line 20, when viewed from the z-axis direction. Therefore, the signal line 20 is entirely covered by the floating conductors 28 and the auxiliary ground conductor 24 except that there are narrow gaps among the floating conductors 28 and the openings 30.

The external terminal 16*a* is, as shown in FIG. 2, a rectangular or substantially rectangular conductor arranged on the front surface of the connector portion 18*a-b* to be located in the center of the connector portion 18*a-b*. Therefore, the external terminal 16*a* overlaps with the negative x-axis end of the signal line 20, when viewed from the z-axis direction. The external terminal 16*b* is, as shown in FIG. 2, a rectangular or substantially rectangular conductor arranged on the front surface of the connector portion 18*a-c* to be located in the center of the connector portion 18*a-c*. Therefore, the external terminal 16*b* overlaps with the positive x-axis end of the signal line 20, when viewed from the z-axis direction. The external terminals 16*a* and 16*b* are made of a metal material with a relatively small specific resistance, such as a silver-based material, a copper-based material or the like. The external terminals 16*a* and 16*b* are plated with Ni/Au. The statement that the external terminals 16*a* and 16*b* are arranged on the front surface of the dielectric sheet 18*a* indicates, for example, that the external terminals 16*a* and 16*b* preferably are formed by plating of the front surface of the dielectric sheet 18*a* with a metal foil and by patterning of the metal foil or that the external terminals 16*a* and 16*b* are preferably formed by sticking of a metal foil onto the front surface of the dielectric sheet 18*b* and by patterning of the metal foil. The surface of the external terminals 16*a* and 16*b* are smoothened, and thus, the surface roughness of the external terminals 16*a* and 16*b* on the surfaces in contact with the dielectric sheet 18*a* is greater than the surface roughness of the external terminals on the surfaces out of contact with the dielectric sheet 18*a*.

As described above, the signal line 20 is sandwiched between the main ground conductor 22 and the auxiliary ground conductor 24 in the z-axis direction. Thus, the signal line 20, the main ground conductor 22 and the auxiliary ground conductor 24 define a triplate stripline structure. The distance in the z-axis direction between the signal line 20 and the main ground conductor 22 is, as shown in FIG. 4, equal or substantially equal to the thickness T1 of the dielectric sheet 18*a* and, for example, preferably within a range from about 50 μm to about 300 μm. In this preferred embodiment, the distance between the signal line 20 and the main ground conductor 22 preferably is about 150 μm, for example. The distance in the z-axis direction between the signal line 20 and the auxiliary ground conductor 24 is, as shown in FIG. 4, equal or substantially equal to the thickness T2 of the dielectric sheet 18*b* and, for example, preferably within a range from about 10 μm to about 100 μm. In this preferred embodiment, the distance between the signal line 20 and the auxiliary ground conductor 24 preferably is about 50 μm, for example. Thus, the distance in the z-axis direction between the auxiliary ground conductor 24 and the signal line 20 is smaller than the distance in the z-axis direction between the main ground conductor 22 and the signal line 20.

The via-hole conductor b1, as shown in FIG. 2, is pierced in the connector portion 18*a-b* of the dielectric sheet 18*a* in the z-axis direction so as to connect the external terminal 16*a* to the negative x-axis end of the signal line 20. The via-hole conductor b2, as shown in FIG. 2, is pierced in the connector portion 18*a-c* of the dielectric sheet 18*a* in the z-axis direction so as to connect the external terminal 16*b* to the positive x-axis end of the signal line 20. Thus, the signal line 20 is connected between the external terminals 16*a* and 16*b*. The via-hole conductors b1 and b2 preferably are formed by filling a metal material in through-holes made in the dielectric sheet 18*a*.

The plurality of via-hole conductors B1, as shown in FIG. 2, are pierced in the line portion 18*a-a* in the z-axis direction. The via-hole conductors B1 are located at the positive y-axis side of the signal line 20 and arranged in a line along the x-axis at uniform intervals. In this preferred embodiment, the via-hole conductors B1 are located in the positive y-axis sides of the respective bridges 60, when viewed from the z-axis direction. The plurality of via-hole conductors B2, as shown in FIGS. 2 and 3, are pierced in the line portion 18*b-a* in the z-axis direction. The via-hole conductors B2 are located at the positive y-axis side of the signal line 20 and are arranged in a line along the x-axis at uniform intervals. In this preferred embodiment, the via-hole conductors B2 are provided in the positive y-axis sides of the respective bridges 60. Each of the via-hole conductors B1 is connected to the abutting via-hole conductor B2 such that the connected via-hole conductors B1 and B2 serve as a single via-hole conductor. The positive z-axis ends of the respective via-hole conductors B1 are connected to the main ground conductor 22, and the negative z-axis ends of the respective via-hole conductors B2 are connected to the auxiliary ground conductor 24. Accordingly, the via-hole conductors B1 and B2 connect the main ground conductor 22 and the auxiliary ground conductor 24 to each other. The via-hole conductors B1 and B2 are preferably formed by filling a metal material in through-holes made in the dielectric sheets 18*a* and 18*b*.

The plurality of via-hole conductors B3, as shown in FIG. 2, are pierced in the line portion 18*a-a* in the z-axis direction. The via-hole conductors B3 are located at the negative y-axis side of the signal line 20 and arranged in a line along the x-axis at uniform intervals. In this preferred embodiment, the via-hole conductors B3 are provided in the negative y-axis sides of the respective bridges 60. The plurality of via-hole conductors B4, as shown in FIGS. 2 and 3, are pierced in the line portion 18*b-a* in the z-axis direction. The via-hole conductors B4 are located at the negative y-axis side of the signal line 20 and arranged in a line along the x-axis at uniform intervals. In this preferred embodiment, the via-hole conductors B4 are provided in the negative y-axis sides of the respective bridges 60. Each of the via-hole conductors B3 is connected to the abutting via-hole conductor B4 such that the connected via-hole conductors B3 and B4 serve as a single via-hole conductor. The positive z-axis ends of the respective via-hole conductors B3 are connected to the main ground conductor 22, and the negative z-axis ends of the respective via-hole conductors B4 are connected to the auxiliary ground conductor 24. Accordingly, the via-hole conductors B3 and B4 connect the main ground conductor 22 and the auxiliary ground conductor 24 to each other. The via-hole conductors B3 and B4 are preferably formed by filling a metal material in through-holes made in the dielectric sheets 18*a* and 18*b*.

The protective layer 14 is an insulating film covering substantially the entire front surface of the dielectric sheet 18*a*. Thus, the main ground conductor 22 is covered by the protective layer 14. The protective layer 14 is made of, for example, flexible resin such as a resist material or the like.

The protective layer 14, as shown by FIG. 2, includes a line portion 14*a*, and connector portions 14*b* and 14*c*. The line portion 14*a* covers the entire front surface of the line portion 18*a-a* and thus covers the line portion 22*a* of the main ground conductor 22.

The connector portion 14*b* is connected to the negative x-axis end of the line portion 14*a* and covers the front surface of the connector portion 18*a-b*. However, the connector portion 14*b* includes openings Ha to Hd. The opening Ha is a rectangular or substantially rectangular opening located in the center of the connector portion 14*b*. The external terminal 16*a* is exposed on the outside through the opening Ha. The opening Hb is a rectangular or substantially rectangular opening located at the positive y-axis side of the opening Ha. The opening Hc is a rectangular or substantially rectangular opening located at the negative x-axis side of the opening Ha. The opening Hd is a rectangular or substantially rectangular opening located at the negative y-axis side of the opening Ha. The terminal portion 22*b* is exposed to the outside through the openings Hb to Hd, and functions as an external terminal.

The connector portion 14*c* is connected to the positive x-axis end of the line portion 14*a* and covers the front surface of the connector portion 18*a-c*. However, the connector portion 14*c* includes openings He to Hg. The opening He is a rectangular or substantially rectangular opening made in the center of the connector portion 14*c*. The external terminal 16*a* is exposed on the outside through the opening He. The opening Hf is a rectangular or substantially rectangular opening located at the positive y-axis side of the opening He. The opening Hg is a rectangular or substantially rectangular opening located at the positive x-axis side of the opening He. The opening Hh is a rectangular or substantially rectangular opening located at the negative y-axis side of the opening He. The terminal portion 22*c* is exposed to the outside through the openings Hf to Hh, and functions as an external terminal.

The protective layer 15 is an insulating film covering substantially the entire back surface of the dielectric sheet 18*b*. Thus, the auxiliary ground conductor 24 is covered by the protective layer 15. The protective layer 15 is made of, for example, flexible resin such as a resist material or the like.

In the high-frequency signal transmission line 10 of the above structure, the characteristic impedance of the signal line 20 changes periodically between an impedance value Z1 and an impedance value Z2. More specifically, in sections Al where the signal line 20 is over the floating conductors 28 and the openings 30, the capacitance generated between the signal line 20 and the auxiliary ground conductor 24 is relatively small. Accordingly, the characteristic impedance of the signal 20 in the sections A1 is of a relatively high value Z1.

On the other hand, in sections A2 where the signal line 20 is over the bridges 60, the capacitance between the signal line 20 and the auxiliary ground conductor 24 is relatively large. Accordingly, the characteristic impedance of the signal 20 in the sections A2 is of a relatively low value Z2. The sections A1 and the sections A2 are arranged alternately in the x-axis direction. Therefore, the characteristic impedance of the signal line 20 changes from the value Z1 to the value Z2 and again to the value Z1 periodically. The impedance value Z1 is, for example, about 55Ω, and the impedance value Z2 is, for example, about 45Ω. The average characteristic impedance of the entire signal line 20 is, for example, about 50Ω.

Figure 6:
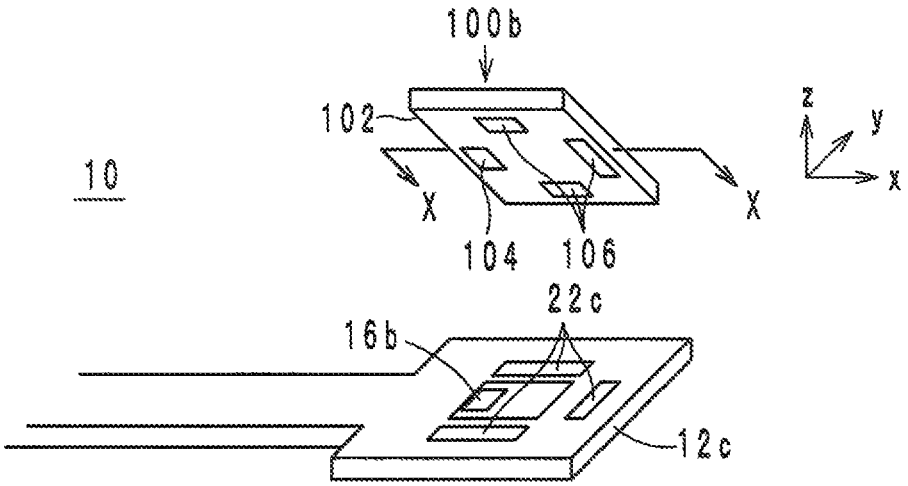
FIG. 6 is a perspective view of a connector of a high-frequency signal transmission line.
Figure 7:
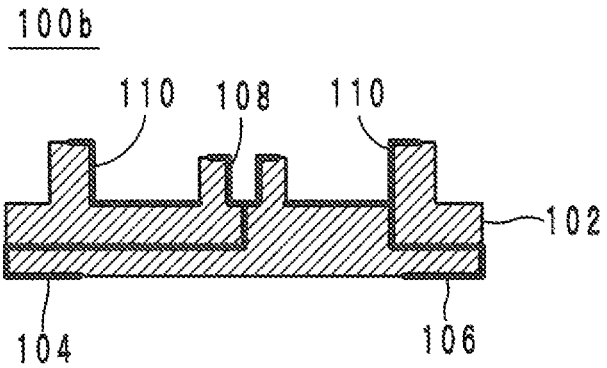
FIG. 7 is a sectional view of the connector of the high-frequency signal transmission line.

The connectors 100*a* and 100*b* are, as shown in FIG. 1, mounted on the connector portions 12*b* and 12*c* respectively. The connectors 100*a* and 100*b* are of the same structure, and only the connector 100*b* will be hereinafter described. FIG. 6 is a perspective view of the connector 100*b* of the high-frequency signal transmission line 10. FIG. 7 is a sectional view of the connector 100*b* of the high-frequency signal transmission line 10.

The connector 100*b*, as shown by FIGS. 1, 6 and 7, includes a connector body 102, external terminals 104 and 106, a central conductor 108 and an external conductor 110. The connector body 102 is in the shape of a combination of a rectangular plate-shaped portion and a cylindrical portion. The connector body 102 is made of an insulating material such as resin.

The external terminal 104 is disposed on the negative z-axis surface of the plate-shaped portion of the connector body 102 in a position opposite the external terminal 16*b*. The external terminals 106 are disposed on the negative z-axis surface of the plate-shaped portion of the connector body 102 in positions opposite the exposed portions of the terminal portion 22*c* exposed through the openings Hf to Hh.

The central conductor 108 is disposed in the center of the cylindrical portion of the connector body 102 and is connected to the external terminal 104. The central conductor 108 is a signal terminal at which a high-frequency signal is input or output. The external conductor 110 is disposed on an inner surface of the cylindrical portion of the connector body 102 and is connected to the external terminals 106. The external conductor 110 is a grounding terminal maintained at a ground potential.

As shown by FIGS. 6 and 7, the connector 100*b* of the structure above is mounted on the connector portion 12*c* such that the external terminal 104 is connected to the external terminal 16*b* and that the external terminals 106 are connected to the terminal portion 22*c*. Thus, the signal line 20 is electrically connected to the central conductor 108. The main ground conductor 22 and the auxiliary ground conductor 24 are electrically connected to the external conductor 110.

Figure 8:
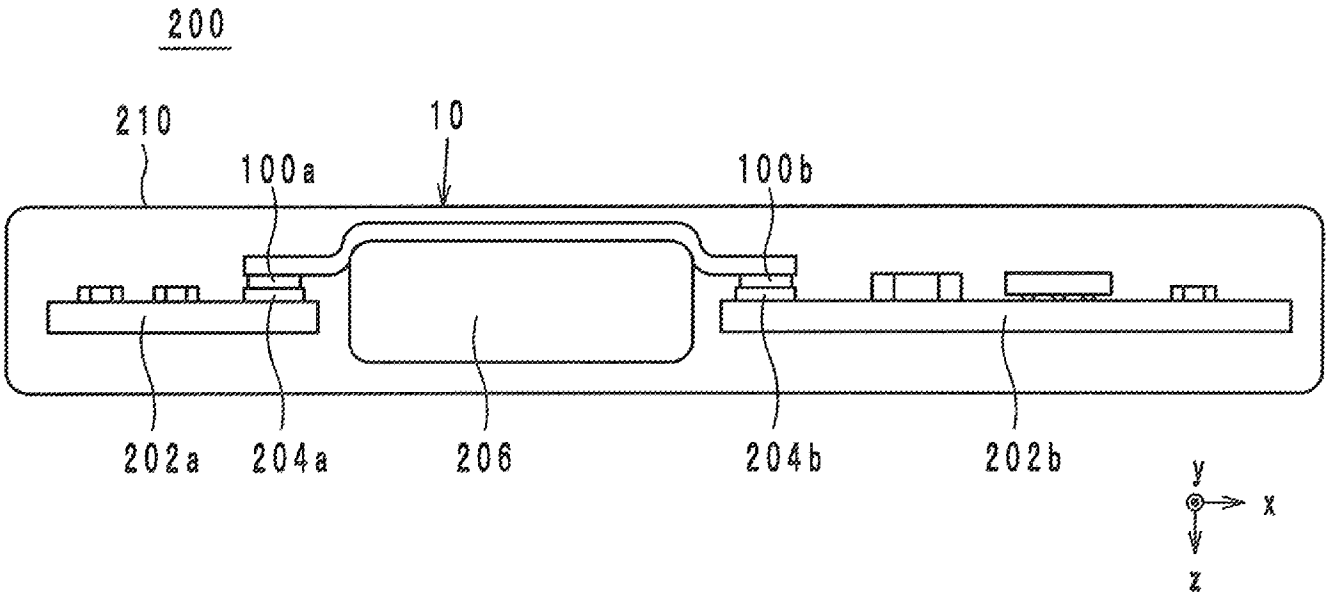
FIG. 8 is a plan view of an electronic device including the high-frequency signal transmission line, viewed from a y-axis direction.
Figure 9:
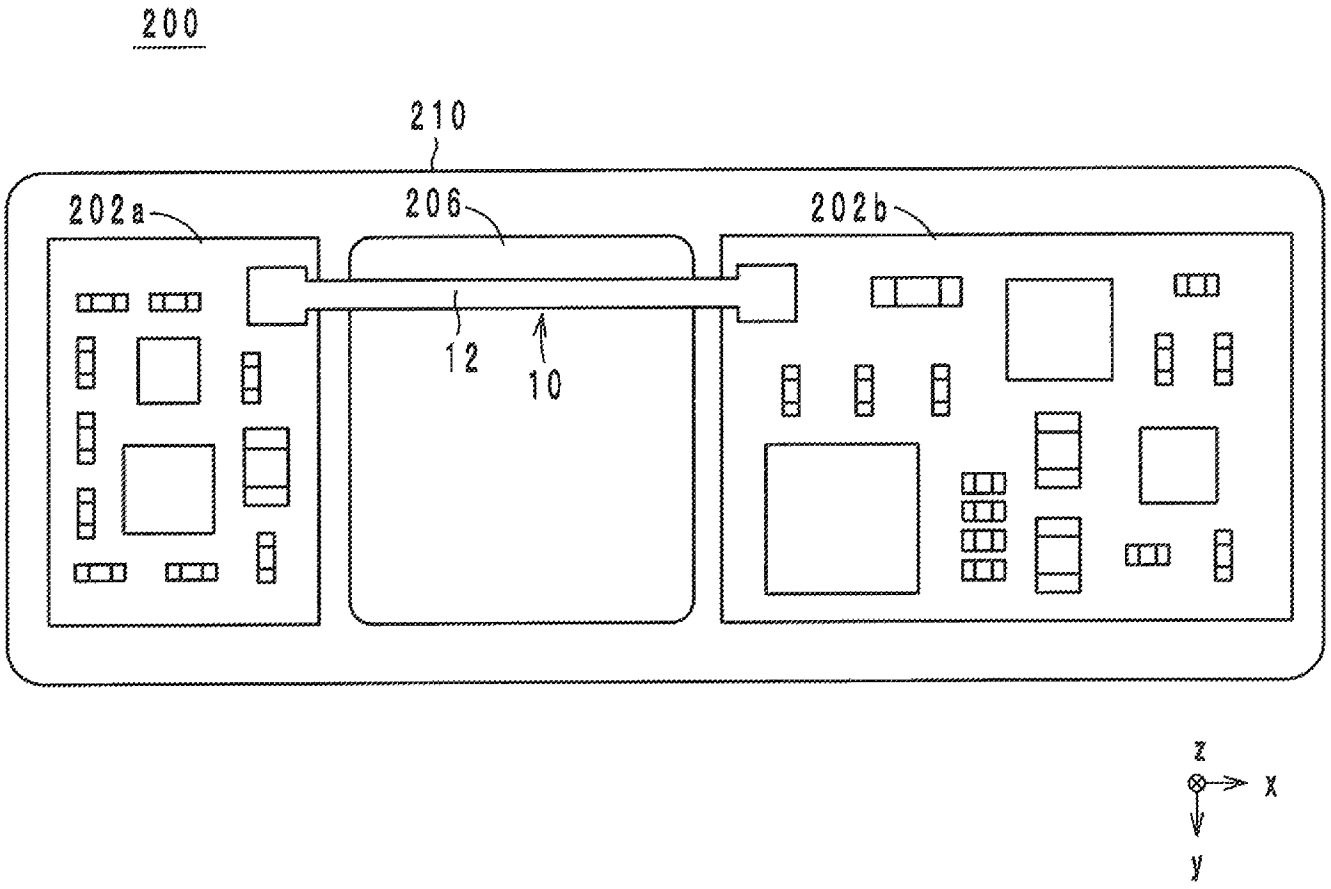
FIG. 9 is a plan view of the electronic device including the high-frequency signal transmission line, viewed from a z-axis direction.

The high-frequency signal transmission line 10 is preferably used as follows. FIG. 8 is a plan view of an electronic device 200 including the high-frequency signal transmission line 10, viewed from the y-axis direction. FIG. 9 is a plan view of the electronic device 200 including the high-frequency signal transmission line 10, viewed from the z-axis direction.

The electronic device 200 includes circuit boards 202*a* and 202*b*, receptacles 204*a* and 204*b*, a battery pack (metal object) 206 and a casing 210 besides the high-frequency signal transmission line 10.

The high-frequency signal transmission line 10, the circuit boards 202*a* and 202*b*, the receptacles 204*a* and 204*b*, and the battery pack 206 are encased in the casing 210. The circuit board 202*a* includes, for example, a transmitting circuit or a receiving circuit. The circuit board 202*b* includes, for example, a feed circuit. The battery pack 206 is, for example, a lithium-ion secondary battery, and the surface of the battery is covered by a metal cover. The circuit board 202*a*, the battery pack 206 and the circuit board 202*b* are arranged in this order from the negative x-axis side to the positive x-axis side.

The receptacles 204*a* and 204*b* are placed on the negative z-axis surfaces of the circuit boards 202*a* and 202*b*, respectively. The connectors 100*a* and 100*b* are connected to the receptacles 204*a* and 204*b*, respectively. Thus, a high-frequency signal, for example, with a frequency of 2 GHz transmitted between the circuit boards 202*a* and 202*b* is applied to the central conductors 108 of the connectors 100*a* and 100*b* via the receptacles 204*a* and 204*b*. In the meantime, the external conductors 110 of the connectors 100*a* and 100*b* are maintained at the ground potential via the circuit boards 202*a* and 202*b*, and the receptacles 204*a* and 204*b*. Thus, the high-frequency signal transmission line 10 connects the circuit boards 202*a* and 202*b* to each other.

In the structure, the front surface of the dielectric body 12 (more precisely, the protective layer 14) is in contact with the battery pack 206, and the dielectric body 12 and the battery pack 206 are joined together by an adhesive or the like. The front surface of the dielectric body 12 is a main surface that is closer to the main ground conductor 22 than to the signal line 20. In other words, the continuous main ground conductor 22 is located between the signal line 20 and the battery pack 206.

An example of a manufacturing method of the high-frequency signal transmission line 10 is described with reference to FIG. 2. The following description is about a production of one high-frequency signal transmission line 10. Practically, however, large-size dielectric sheets are stacked into a laminate, and the laminate is cut into pieces, such that a plurality of high-frequency signal transmission lines 10 are produced at one time.

First, as the dielectric sheet 18*a*, a sheet of thermoplastic resin with a copper foil (metal film) spread on the entire front surface is prepared. More specifically, a copper foil is stuck onto the front surface of the dielectric sheet 18*a*. Further, the front surface of the dielectric sheet 18*a* is, for example, plated with zinc for anticorrosion and is smoothened. The dielectric sheet 18*a* is liquid crystal polymer. The thickness of the copper foil is preferably within a range from about 10 μm to about 20 μm, for example.

Next, as the dielectric sheet 18*b*, a sheet of thermoplastic resin with copper foils (metal films) spread entirely on both main surfaces is prepared. More specifically, copper foils are stuck onto the both surfaces of the dielectric sheet 18*b*. Further, the front surface of the dielectric sheet 18*b* is, for example, plated with zinc for anticorrosion and is smoothened. The dielectric sheet 18*b* is liquid crystal polymer. The thicknesses of the copper foils are preferably within a range from about 10 μm to about 20 μm, for example.

The external terminals 16*a* and 16*b*, and the main ground conductor 22 are formed on the front surface of the dielectric sheet 18*a* by patterning of the copper foil stuck on the front surface of the dielectric sheet 18*a*. More specifically, a resist corresponding to the shapes of the external terminals 16*a* and 16*b*, and the main ground conductor 22 is printed on the copper foil on the front surface of the dielectric sheet 18*a*, and the copper foil is etched. Thus, the portions of the copper foil that are not covered by the resist are removed. Thereafter, a resist remover is sprayed to remove the resist. Thus, the external terminals 16*a* and 16*b*, and the main ground conductor 22 are formed on the front surface of the dielectric sheet 18*a* as shown in FIG. 2 by photolithography.

Next, the signal line 20 is formed on the front surface of the dielectric sheet 18*b* as shown in FIG. 2. Further, the auxiliary ground conductor 24 and the floating conductors 28 are formed on the back surface of the dielectric sheet 18*b* as shown in FIG. 2. The process of forming the signal line 20 and the process of forming the auxiliary ground conductor 24 and the floating conductors 28 are the same as the process of forming the external terminals 16*a* and 16*b*, and the main ground conductor 22, and descriptions of the processes are omitted.

Next, through-holes are made in the dielectric sheets 18*a* and 18*b* by laser beam radiation at positions where the via-hole conductors b1, b2 and B1 to B4 are to be formed. Thereafter, conductive paste is filled in the through-holes, and thus the via-hole conductors b1, b2 and B1 to B4 are formed.

Next, the dielectric sheets 18*a* and 18*b* are stacked in this order from the positive z-axis side to the negative z-axis side, thus forming the dielectric body 12. Heat and pressure are applied to the stacked dielectric sheets 18*a* and 18*b* from the positive z-axis side and the negative z-axis side, such that the dielectric sheets 18*a* and 18*b* are unified.

Next, resin (resist) paste is applied on the front surface of the dielectric sheet 18*a* by screen printing, such that the protective layer 14 covering the main ground conductor 22 is formed.

Resin (resist) paste is applied on the back surface of the dielectric sheet 18*b* by screen printing, such that the protective layer 15 covering the auxiliary ground conductor 24 is formed.

Lastly, the connectors 100*a* and 100*b* are mounted on the connector portions 12*b* and 12*c*, and the external terminals 104 and 106 of the connectors 100*a* and 100*b* are connected to the external terminals 16*a* and 16*b* and the terminal portions 22*b* and 22*c* of the connector portions 12*b* and 12*c* by solder. In this way, the high-frequency signal transmission line 10 shown by FIG. 1 is completed.

The high-frequency signal transmission line 10 of the structure above inhibits electromagnetic wave leakage to the outside through the openings 30 of the auxiliary ground conductor 24. More specifically, in the high-frequency signal transmission line 10, the floating conductors 28 are placed over the openings 30, when viewed from the z-axis direction. The floating conductors 28 are located at the negative z-axis side of the signal line 20, and each of the floating conductors 28 is not connected to any other conductors. With this arrangement, magnetic fluxes Φ generated by a flow of a high-frequency signal on the signal line 20 are, as shown in FIG. 5, shut in the dielectric body 12 by the floating conductors 28. Accordingly, leakage of the magnetic fluxes Φ from the dielectric body 12 is prevented. Further, lines of electric force radiated from the signal line 20 are absorbed in the floating conductors 28. Accordingly, lines of electric force are prevented from leaking from the dielectric body 12 to the outside. Consequently, the high-frequency signal transmission line 10 prevents electromagnetic waves from leaking to the outside through the openings 30 of the auxiliary ground conductor 24.

In the high-frequency signal transmission line 10, the provision of the floating conductors 28 does not cause the characteristic impedance of the signal line 20 to vary from a designed value largely. More specifically, as shown in FIG. 5, since the area where the signal line 20 and the floating conductors 28 are opposed to each other is large, the capacitance C1 generated between the floating conductors 28 and the signal line 20 is large. Meanwhile, since the area where the floating conductors 28 and the auxiliary ground conductor 24 are opposed to each other is very small, the capacitance C2 generated between the floating conductors 28 and the auxiliary ground conductor 24 is very small. Each of the floating conductors 28 is not connected to any other conductors and is maintained at a floating potential. Therefore, between the signal line 20 and the ground (the auxiliary ground conductor 24), the capacitance C1 and the capacitance C2 are connected in series. Since the capacitance C2 is very much smaller than the capacitance C1, the combined capacitance of the capacitance C1 and the capacitance C2 becomes equal or substantially equal to the capacitance C2, which is very small. Thus, the resultant capacitance between the signal line 20 and the auxiliary ground conductor 24 caused by the provision of the floating conductors 28 is equal or substantially equal to the capacitance C2, which is very small. In other words, a change in characteristic impedance of the signal line 20 caused by the provision of the floating conductors 28 is very small. As thus far described, the provision of the floating conductors 28 in the high-frequency signal transmission line 10 does not cause the characteristic impedance of the signal line 20 to vary from a designed value largely.

The above-described structure permits the high-frequency signal transmission line 10 to be made thinner. More specifically, in the high-frequency signal transmission line 10, in the sections A1, the signal line 20 does not overlap with the auxiliary ground conductor 24, when viewed from the z-axis direction. Therefore, the capacitance generated between the signal line 20 and the auxiliary ground conductor 24 in the sections A1 is very small. Therefore, a decrease in the distance in the z-axis direction between the signal line 20 and the auxiliary ground conductor 24 does not cause so large an increase in capacitance between the signal line 20 and the auxiliary ground conductor 24 and accordingly does not cause so large a variation in characteristic impedance of the signal line 20 from a designed value (for example, 50Ω). Thus, it is possible to make the high-frequency signal transmission line 10 thinner while keeping the characteristic impedance of the signal line 20 at a desired value.

When the high-frequency signal transmission line 10 is attached to a metal object such as the battery pack 206, the high-frequency signal transmission line 10 inhibits the characteristic impedance of the signal line 20 from varying from the designed value. More specifically, the high-frequency signal transmission line 10 is attached to the battery pack 206 such that the continuous main ground conductor 22 is located between the signal line 20 and the battery pack 206. Accordingly, it never occurs that the signal line 20 is opposed to the battery pack 206 via the openings 30, and therefore, it is prevented that capacitance is generated between the signal line 20 and the battery pack 206. Thus, the adhesion of the high-frequency signal transmission line 10 to the battery pack 206 does not cause a decrease in the characteristic impedance of the signal line 20.

In the high-frequency signal transmission line 10, the floating conductors 28 function as a magnetic shield and an electric shield as described above. Therefore, even when the high-frequency signal transmission line 10 is arranged such that the back surface of the dielectric body 12 is located near a metal portion such as a wall of the casing of the electronic device, it is prevented that the signal line 20 and the metal portion are electromagnetically coupled with each other. Accordingly, the high-frequency signal transmission line 10 effectively prevents the characteristic impedance of the signal line 20 from varying from a desired value.

Figure 10:
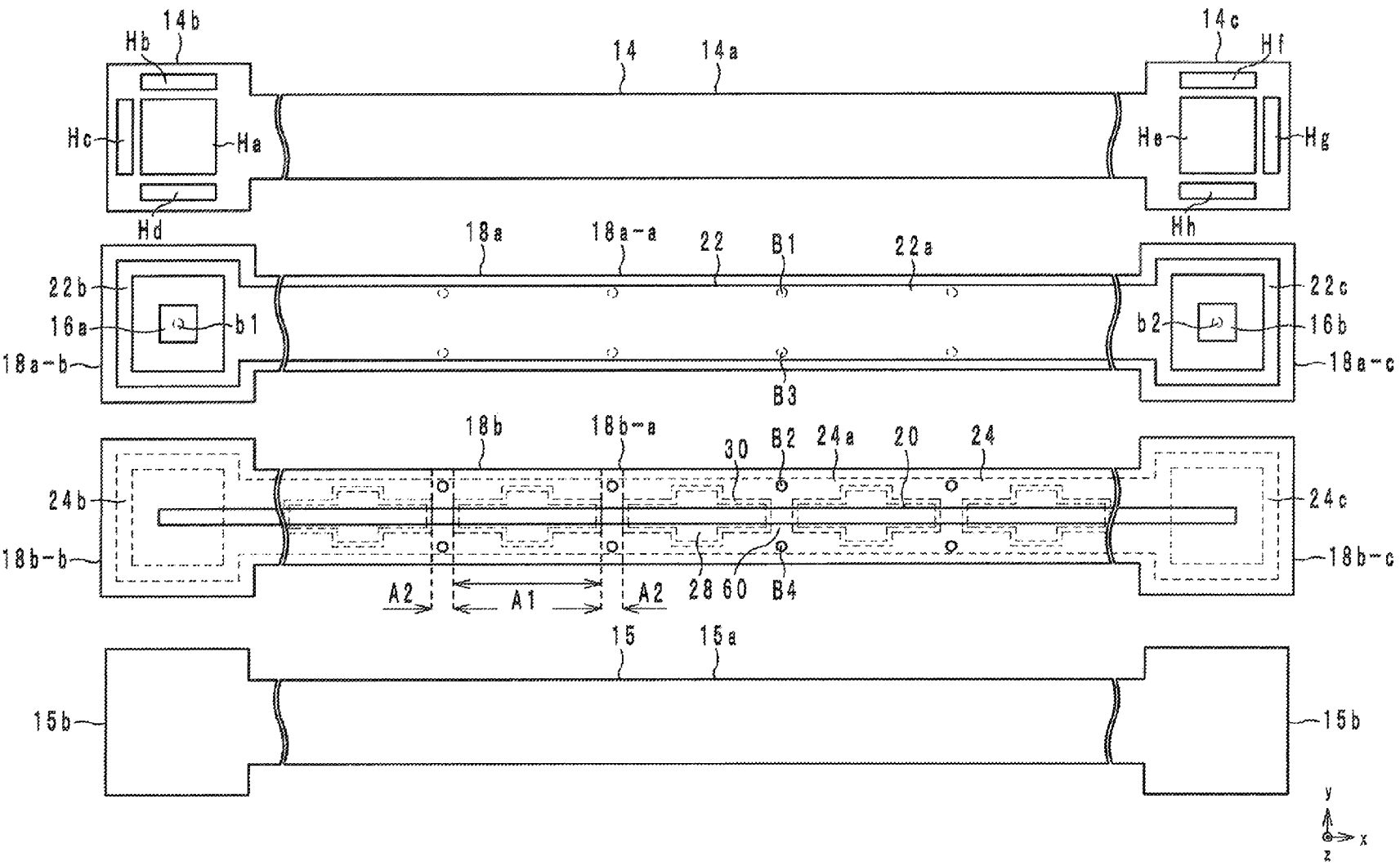
FIG. 10 is an exploded view of a dielectric body of a high-frequency signal transmission line according to a first modification of a preferred embodiment of the present invention.

Next, a high-frequency signal transmission line according to a first modification of a preferred embodiment of the present invention is described with reference to the drawings. FIG. 10 is an exploded view of the dielectric body 12 of the high-frequency signal transmission line 10*a* according to the first modification. The perspective view of FIG. 1 also shows the appearance of the high-frequency signal transmission line 10*a*.

The high-frequency signal transmission line 10*a* is different from the high-frequency signal transmission line 10 in shapes of the floating conductors 28 and the openings 30. More specifically, in the high-frequency signal transmission line 10*a*, the floating conductors 28 and the openings 30 are each in the shape of a cross. Each of the openings 30 has a greater size in the y-axis direction (width) in the center portion with respect to the x-axis direction than in the side portions with respect to the x-axis direction. Likewise, each of the floating conductors 28 has a greater size in the y-axis direction (width) in the center portion with respect to the x-axis direction than in the side portions with respect to the x-axis direction. A narrow gap exists between the outer edge of each of the floating conductors 28 and the outer edge of the corresponding opening 30. Accordingly, each of the floating conductors 28 is not connected to any other conductors and is maintained at a floating potential.

The high-frequency signal transmission line 10*a*, like the high-frequency signal transmission line 10, prevents electromagnetic wave leakage to the outside through the openings 30 of the auxiliary ground conductor 24.

In the high-frequency signal transmission line 10*a*, like in the high-frequency signal transmission line 10, the provision of the floating conductors 28 does not cause the characteristic impedance of the signal line 20 to vary from a designed value largely.

Like the high-frequency signal transmission line 10, the high-frequency signal transmission line 10*a* is thinner.

Like the high-frequency signal transmission line 10, when the high-frequency signal transmission line 10*a* is attached to a metal object such as the battery pack 206, the high-frequency signal transmission line 10*a* inhibits the characteristic impedance of the signal line 20 from varying from the designed value.

In the high-frequency signal transmission line 10*a*, the distance between the signal line 20 and the auxiliary ground conductor 24 in the center portion with respect to the x-axis direction of each opening 30 is greater than the distance between the signal line 20 and the auxiliary ground conductor 24 in the side portions with respect to the x-axis direction of the opening 30. Accordingly, the capacitance generated between the signal line 20 and the auxiliary ground conductor 24 in the center portion of each opening 30 with respect to the x-axis direction is smaller than the capacitance generated between the signal line 20 and the auxiliary ground conductor 24 in the side portions of the opening with respect to the x-axis direction. Therefore, the characteristic impedance of the signal line 20 in the center portion of each opening 30 with respect to the x-axis direction is greater than the characteristic impedance of the signal line 20 in the side portions of the opening 30 with respect to the x-axis direction.

Meanwhile, in each bridge portion where each of the bridges 60 is located, the signal line 20 is opposed to the auxiliary ground conductor 24 in a large area. Accordingly, the capacitance generated between the signal line 20 and the ground conductor 24 in the bridge portion is larger than the capacitance generated between the signal line 20 and the ground conductor 24 in the side portions of each opening 30 with respect to the x-axis direction. Therefore, the characteristic impedance of the signal line 20 in each bridge portion is smaller than the characteristic impedance of the signal line 20 in the side portions of each opening 30 with respect to the x-axis direction.

As described above, the characteristic impedance of the signal line 20 changes between two adjacent bridge portions as follows: the characteristic impedance of the signal line 20 in a bridge portion is at a minimum; the characteristic impedance of the signal line 20 in the negative x-axis side portion of an opening 30 is an intermediate value; the characteristic impedance of the signal line 20 in the center portion of the opening 30 is at a maximum; the characteristic impedance of the signal line 20 in the positive x-axis side portion of the opening 30 is an intermediate value; and the characteristic impedance of the signal line 20 in the next bridge portion is at a minimum. Thus, the characteristic impedance of the signal line 20 changes in a step-by-step manner. Thus, reflection of a high-frequency signal in the signal line 20 is prevented.

Figure 11:
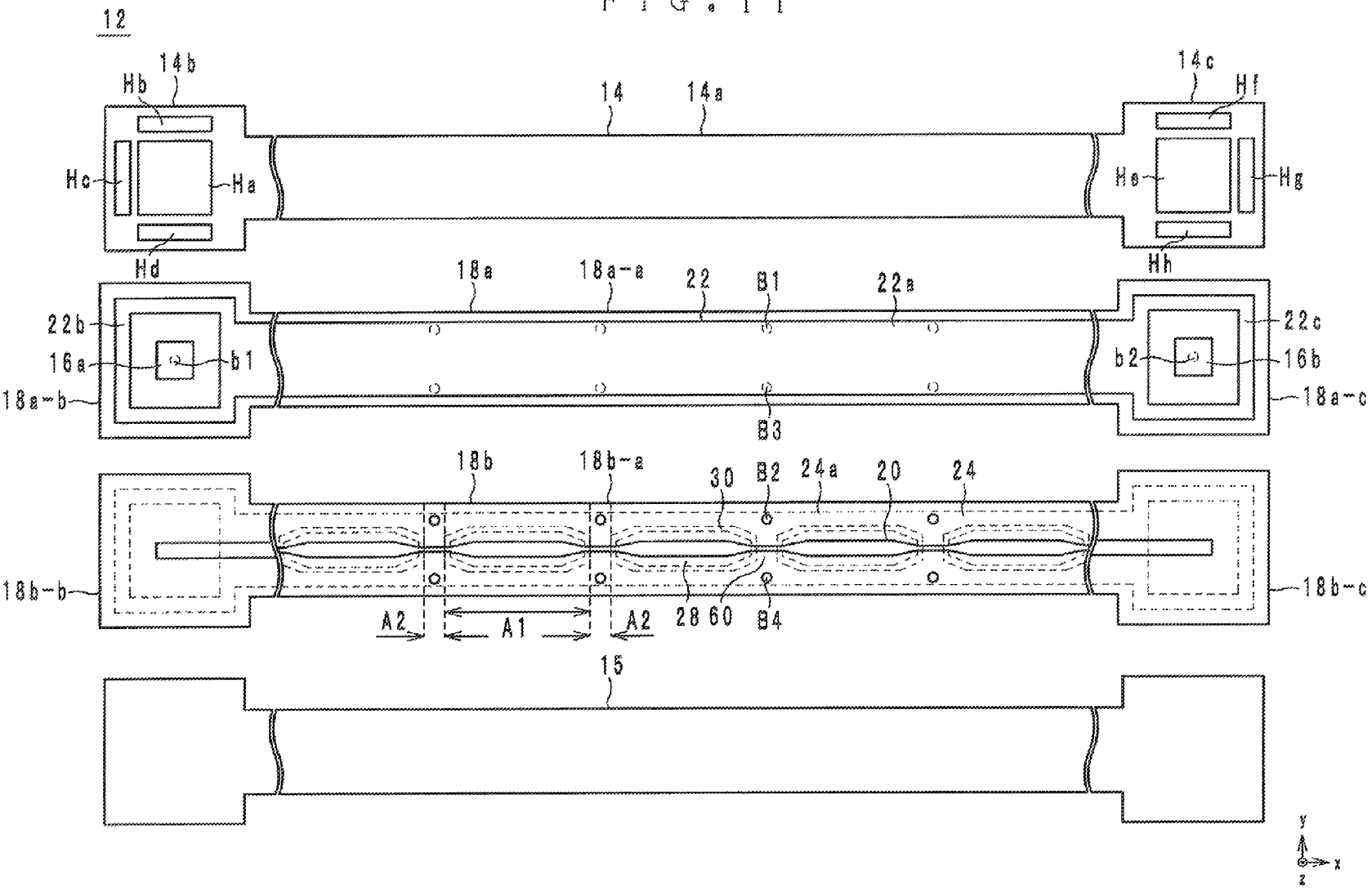
FIG. 11 is an exploded view of a dielectric body of a high-frequency signal transmission line according to a second modification of a preferred embodiment of the present invention.

Next, a high-frequency signal transmission line according to a second modification of a preferred embodiment of the present invention is described with reference to the drawings. FIG. 11 is an exploded view of the dielectric body 12 of the high-frequency signal transmission line 10*b* according to the second modification. The perspective view of FIG. 1 also shows the appearance of the high-frequency signal transmission line 10*b*.

The high-frequency signal transmission line 10*b* is different from the high-frequency signal transmission line 10 in shapes of the floating conductors 28, the openings 30 and the signal line 20. More specifically, in the high-frequency signal transmission line 10*b*, the floating conductors 28 and the openings 30 are each, as shown in FIG. 11, tapered in both side portions with respect to the x-axis direction. A narrow gap exists between the outer edge of each of the floating conductors 28 and the outer edge of the corresponding opening 30. Accordingly, each of the floating conductors 28 is not connected to any other conductors and is maintained at a floating potential.

Also, the signal line 20 has a narrow width in the sections A2 than in the sections A1. The signal line 20 is tapered in both side portions of each section A1 with respect to the x-axis direction.

The high-frequency signal transmission line 10*b* of the structure above, like the high-frequency signal transmission line 10, prevents electromagnetic wave leakage to the outside through the openings 30 of the auxiliary ground conductor 24.

In the high-frequency signal transmission line 10*b*, like in the high-frequency signal transmission line 10, the provision of the floating conductors 28 does not cause the characteristic impedance of the signal line 20 to vary from a designed value largely.

Like the high-frequency signal transmission line 10, the high-frequency signal transmission line 10*b* is thinner.

Like the high-frequency signal transmission line 10, when the high-frequency signal transmission line 10*b* is attached to a metal object such as the battery pack 206, the high-frequency signal transmission line 10*b* inhibits the characteristic impedance of the signal line 20 from varying from the designed value.

Like the high-frequency signal transmission line 10*a*, the high-frequency signal transmission line 10*b* prevents reflection of a high-frequency signal in the signal line 20.

In the high-frequency signal transmission line 10*b*, the effect of inhibiting reflection of a high-frequency signal in the signal line 20 is stronger. More specifically, each of the openings 30 is tapered in its both side portions with respect to the x-axis direction. Thus, in each of the tapered side portions, the distance between the signal line 20 and the auxiliary ground conductor 24 changes gradually. Accordingly, in each of the tapered side portions, the capacitance generated between the signal line 20 and the auxiliary ground conductor 24 changes gradually, and the characteristic impedance of the signal line 20 changes gradually. Therefore, reflection of a high-frequency signal in the signal line 20 is prevented more effectively.

The high-frequency signal transmission line 10*b* causes a lower insertion loss. More specifically, in the sections A1, the signal line 20 does not overlap with the auxiliary ground conductor 24. Accordingly, in the sections A1, it is likely that small capacitance is generated between the signal line 20 and the auxiliary ground conductor 24. On the other hand, in the sections A2, the signal line 20 is located over the auxiliary ground conductor 24. Accordingly, in the sections A2, it is likely that large capacitance is generated between the signal line 20 and the auxiliary ground conductor 24. For this reason, the width of the signal line 20 in the sections A1 is set smaller than in the sections A2. With this arrangement, an increase in capacitance between the signal line 20 and the auxiliary ground conductor 24 in the sections A1 is avoided or substantially avoided, and the resistance of the signal line 20 in the sections A1 can be reduced. Consequently, the insertion loss of the high-frequency signal transmission line 10*b* is significantly reduced or prevented.

Figure 12:
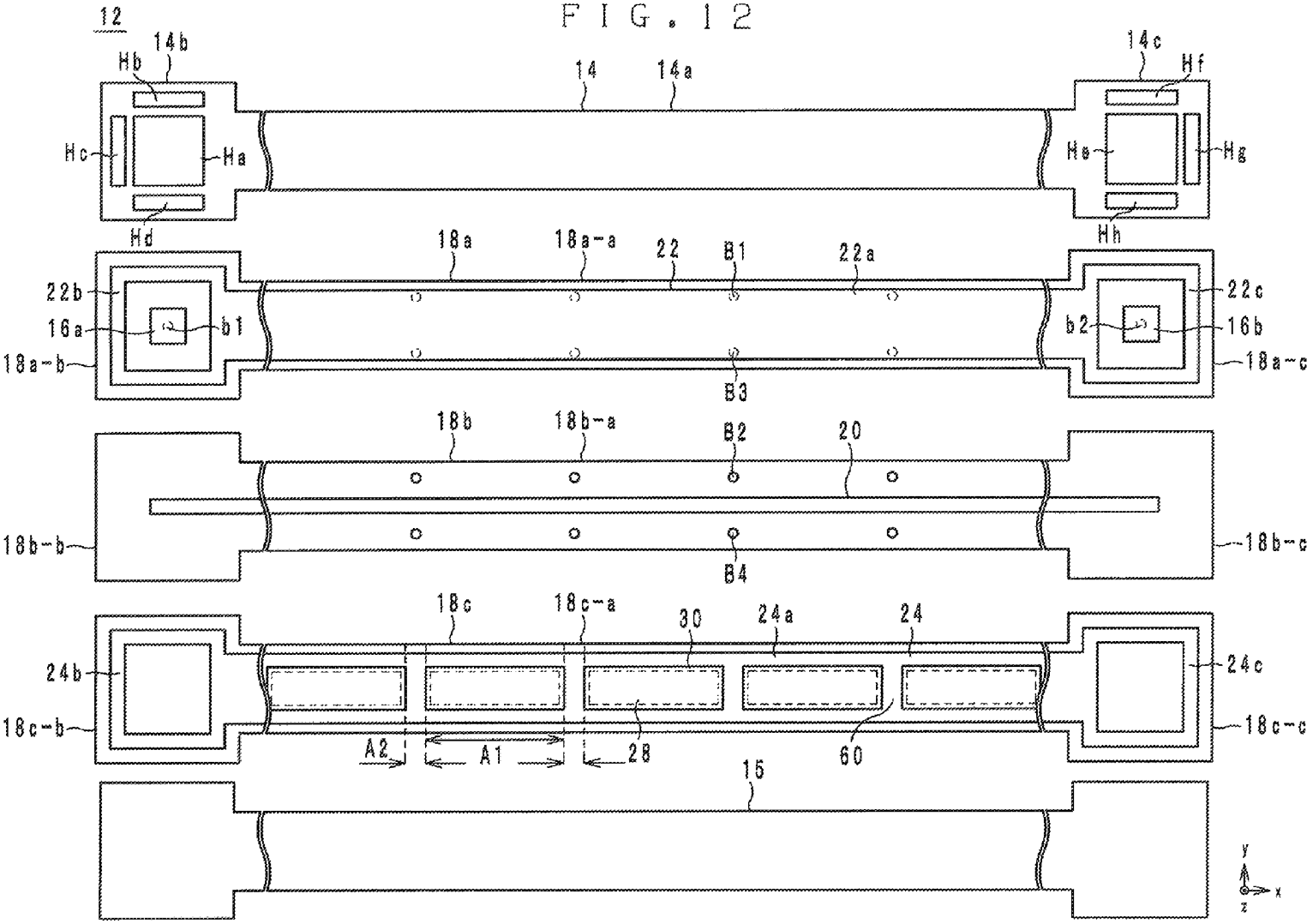
FIG. 12 is an exploded view of a dielectric body of a high-frequency signal transmission line according to a third modification of a preferred embodiment of the present invention.

Next, a high-frequency signal transmission line according to a third modification of a preferred embodiment of the present invention is described with reference to the drawings. FIG. 12 is an exploded view of the dielectric body 12 of the high-frequency signal transmission line 10*c* according to the third modification. The perspective view of FIG. 1 also shows the appearance of the high-frequency signal transmission line 10*c*.

The high-frequency signal transmission line 10*c* is different from the high-frequency signal transmission line 10 in that the high-frequency signal transmission line 10*c* further includes a dielectric sheet 18*c* and in that the auxiliary ground conductor 24 and the floating conductors 28 are disposed on the dielectric sheet 18*c*.

More specifically, the dielectric body 12 preferably is formed by stacking the protective layer 14, the dielectric sheets 18*a* to 18*c*, and the protective layer 15 in this order from the positive z-axis side. The auxiliary ground conductor 24 is located on the front surface of the dielectric sheet 18*c*. The floating conductors 28 are located on the back surface of the dielectric sheet 18*c*. Thus, the floating conductors 28 are located at the negative z-axis side of the auxiliary ground conductor 24.

The high-frequency signal transmission line 10*c* of the structure above, like the high-frequency signal transmission line 10, prevents electromagnetic wave leakage to the outside through the openings 30 of the auxiliary ground conductor 24.

In the high-frequency signal transmission line 10*c*, like in the high-frequency signal transmission line 10, the provision of the floating conductors 28 does not cause the characteristic impedance of the signal line 20 to vary from a designed value largely.

Like the high-frequency signal transmission line 10, the high-frequency signal transmission line 10*c* is thinner.

Like the high-frequency signal transmission line 10, when the high-frequency signal transmission line 10*c* is attached to a metal object such as the battery pack 206, the high-frequency signal transmission line 10*c* inhibits the characteristic impedance of the signal line 20 from varying from the designed value.

In the high-frequency signal transmission line 10*c*, each of the floating conductors 28 is located in the corresponding opening 30, when viewed from the z-axis direction. Each of the floating conductors 28 may be identical with the corresponding opening 30 or may be a little larger than the corresponding opening 30. Thus, the effect of inhibiting electromagnetic wave leakage through the openings 30 becomes stronger.

The distance between the signal line 20 and the floating conductors 28 in the high-frequency signal transmission line 10*c* is greater than the distance between the signal line 20 and the floating conductors 28 in the high-frequency signal transmission line 10. Accordingly, the capacitance between the signal line 20 and the floating conductors 28 in the high-frequency signal transmission line 10*c* is smaller than the capacitance between the signal line 20 and the floating conductors 28 in the high-frequency signal transmission line 10. Therefore, the variation in characteristic impedance of the signal line 20 caused by the provision of the floating conductors 28 to the high-frequency signal transmission line 10*c* is smaller than the variation in characteristic impedance of the signal line 20 caused by the provision of the floating conductors 28 to the high-frequency signal transmission line 10.

Figure 13:
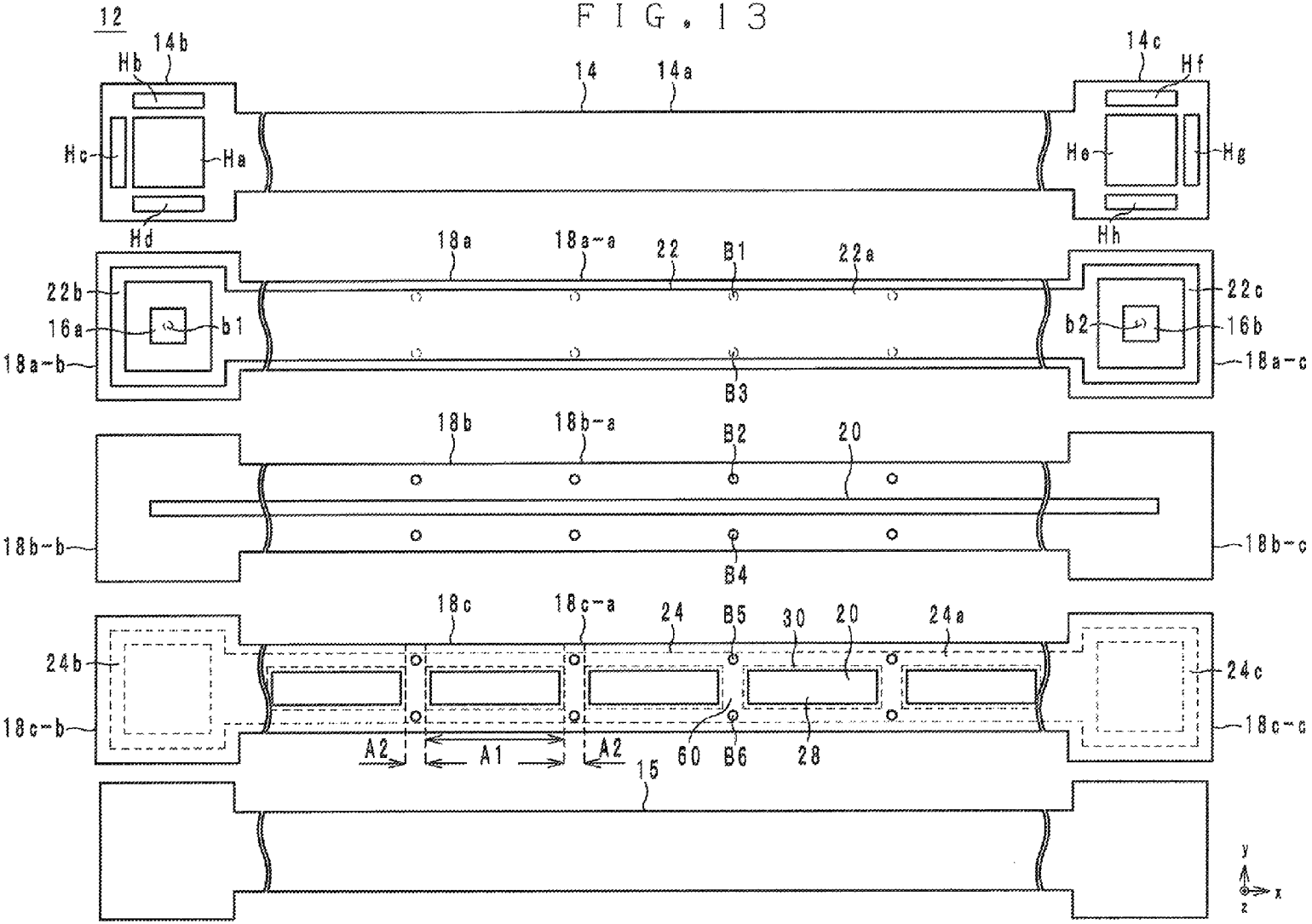
FIG. 13 is an exploded view of a dielectric body of a high-frequency signal transmission line according to a fourth modification of a preferred embodiment of the present invention.

Next, a high-frequency signal transmission line according to a fourth preferred embodiment of the present invention is described with reference to the drawings. FIG. 13 is an exploded view of the dielectric body 12 of the high-frequency signal transmission line 10*d* according to the fourth modification of a preferred embodiment of the present invention. The perspective view of FIG. 1 also shows the appearance of the high-frequency signal transmission line 10*d*.

The high-frequency signal transmission line 10*d* is different from the high-frequency signal transmission line 10*c* in the locations of the auxiliary ground conductor 24 and the floating conductors 28.

More specifically, in the high-frequency signal transmission line 10*d*, the auxiliary ground conductor 24 is located on the back surface of the dielectric sheet 18*c*. The floating conductors 28 are located on the front surface of the dielectric sheet 18*c*.

The high-frequency signal transmission line 10*d* further includes via-hole conductors B5 pierced in the dielectric sheets 18*c* in the z-axis direction. The via-hole conductors B1, B2 and B5 abutting each other serve as a single via-hole conductor to connect the main ground conductor 22 and the auxiliary ground conductor 24.

The high-frequency signal transmission line 10*d* further includes via-hole conductors B6 pierced in the dielectric sheets 18*c* in the z-axis direction. The via-hole conductors B3, B4 and B6 abutting each other serve as a single via-hole conductor to connect the main ground conductor 22 and the auxiliary ground conductor 24.

The high-frequency signal transmission line 10*d* of the structure above, like the high-frequency signal transmission line 10*c*, prevent electromagnetic wave leakage to the outside through the openings 30 of the auxiliary ground conductor 24.

In the high-frequency signal transmission line 10*d*, like in the high-frequency signal transmission line 10*c*, the provision of the floating conductors 28 does not cause the characteristic impedance of the signal line 20 to vary from a designed value largely.

Like the high-frequency signal transmission line 10*c*, the high-frequency signal transmission line 10*d* is thinner.

Like the high-frequency signal transmission line 10*c*, when the high-frequency signal transmission line 10*d* is attached to a metal object such as the battery pack 206, the high-frequency signal transmission line 10*d* inhibits the characteristic impedance of the signal line 20 from varying from the designed value.

In the high-frequency signal transmission line 10*d*, each of the floating conductors 28 is located in the corresponding opening 30, when viewed from the z-axis direction. Each of the floating conductors 28 may be identical with the corresponding opening 30 and may be a little larger than the corresponding opening 30. Thus, the effect of inhibiting electromagnetic wave leakage through the openings 30 becomes stronger.

Figure 14:
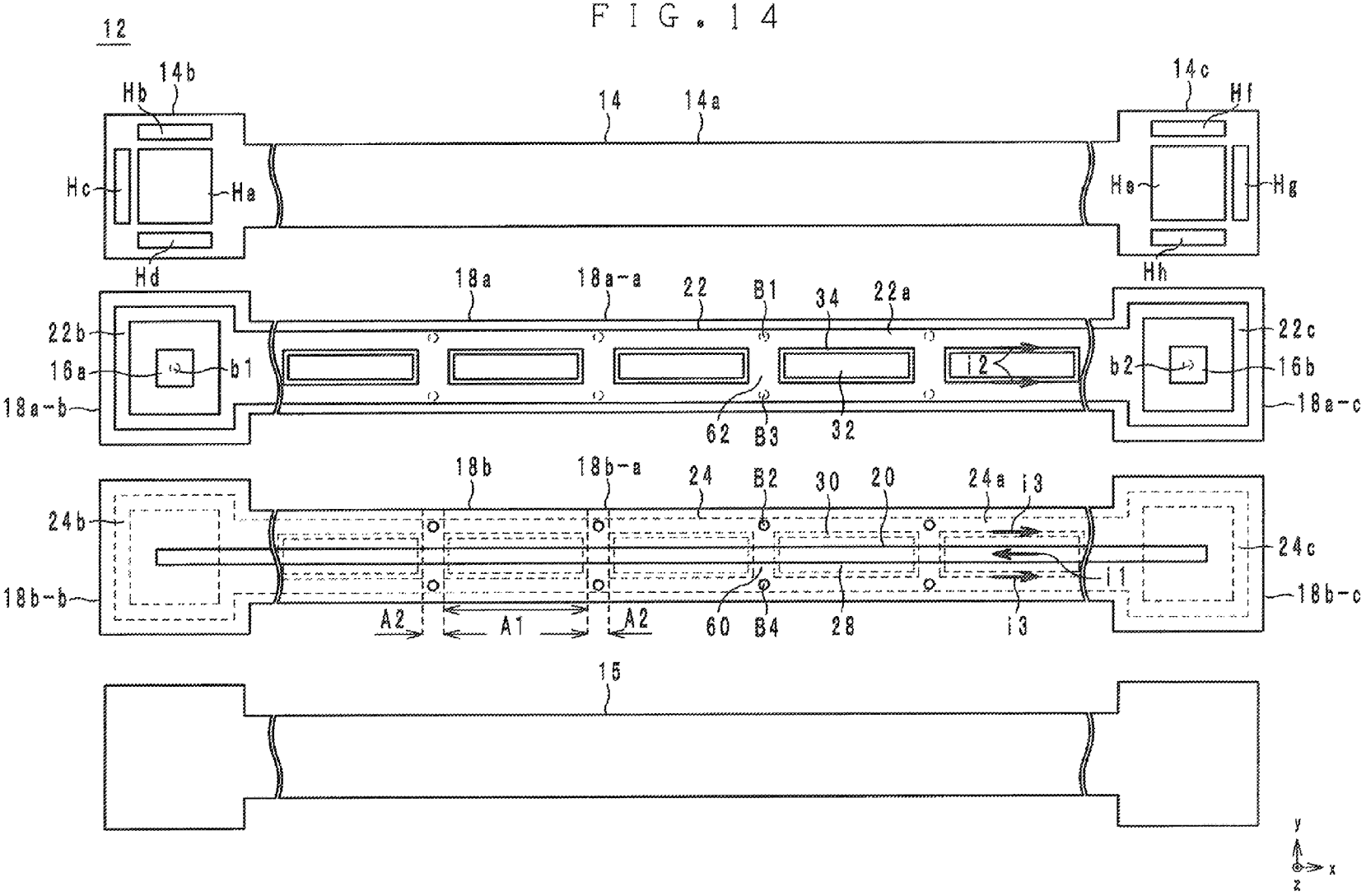
FIG. 14 is an exploded view of a dielectric body of a high-frequency signal transmission line according to a fifth modification of a preferred embodiment of the present invention.

Next, a high-frequency signal transmission line according to a fifth preferred embodiment of the present invention is described with reference to the drawings. FIG. 14 is an exploded view of the dielectric body 12 of the high-frequency signal transmission line 10*e* according to the fifth modification of a preferred embodiment of the present invention. The perspective view of FIG. 1 also shows the appearance of the high-frequency signal transmission line 10*e*.

The high-frequency signal transmission line 10*e* is different from the high-frequency signal transmission line 10 in that the main ground conductor 22 of the high-frequency signal transmission line 10*e* include openings 34 and in that the high-frequency signal transmission line 10*e* further includes floating conductors 32.

More specifically, the line portion 22*a* of the main ground conductor 22 includes, as shown in FIG. 14, a plurality of rectangular or substantially rectangular openings 34 arranged in the x-axis direction. Accordingly, the line portion 22*a* is in the shape of a ladder. Portions of the main ground conductor 22 among the openings 34 are referred to as bridges 62. The respective bridges 62 extend in the y-axis direction. The plurality of openings 30 and the bridges 60 are arranged alternately along the signal line 20 to overlap with the signal line 20, when viewed from the z-axis direction. In this preferred embodiment, the signal line 20 extends in the x-axis direction while crossing the centers of the respective openings 34 and the respective bridges 62 with respect to the y-axis direction.

The size of the openings 34 is smaller than the size of the openings 30. More specifically, the size in the x-axis direction (length) of the openings 34 is smaller than the size in the x-axis direction (length) of the openings 30. The size in the y-axis direction (width) of the openings 34 is smaller than the size in the y-axis direction (width) of the openings 30. When viewed from the z-axis direction, the outer edges of the openings 30 and the outer edges of the openings 34 do not overlap with each other. Each of the openings 34 is located inside the corresponding opening 30, when viewed from the z-axis direction.

The floating conductors 32 are each located over an opening 34, when viewed from the z-axis direction, and the floating conductors 32 are located at the positive z-axis side of the signal line 20. In this preferred embodiment, the floating conductors 32 are located on the front surface of the dielectric sheet 18*a*, on which the main ground conductor 22 is also located. The floating conductors 32 and the openings 34 are provided on a one-to-one basis.

The size in the x-axis direction (length) of the floating conductors 32 is a little smaller than the size in the x-axis direction (length) of the openings 34. Also, the size in the y-axis direction (width) of the floating conductors 32 is smaller than the size in the y-axis direction (width) of the openings 34. Each of the floating conductors 34 is located inside the corresponding opening 34 without contacting with the outer edge of the opening 34, when viewed from the z-axis direction. Accordingly, a narrow gap exists between each of the floating conductors 32 and the outer edge of the corresponding opening 34. Thus, each of the floating conductors 32 is not connected to any other conductors and is maintained at a floating potential.

The floating conductors 32 overlap with the signal line 20, when viewed from the z-axis direction. Thus, the signal line 20 is covered by the floating conductors 32 and the main ground conductor 22 except that there are narrow gaps among the floating conductors 32 and the openings 22.

The high-frequency signal transmission line 10*e* of the structure above, like the high-frequency signal transmission line 10, prevents electromagnetic wave leakage to the outside through the openings 30 of the auxiliary ground conductor 24.

In the high-frequency signal transmission line 10*e*, like in the high-frequency signal transmission line 10, the provision of the floating conductors 28 does not cause the characteristic impedance of the signal line 20 to vary from a designed value largely.

Like the high-frequency signal transmission line 10, the high-frequency signal transmission line 10*e* is made thinner.

Like the high-frequency signal transmission line 10, when the high-frequency signal transmission line 10*e* is attached to a metal object such as the battery pack 206, the high-frequency signal transmission line 10*e* inhibits the characteristic impedance of the signal line 20 from varying from the designed value.

Further, the high-frequency signal transmission line 10*e* causes a lower insertion loss. In the high-frequency signal transmission line 10*e*, a current flow i1 in the signal line 20 causes a feedback current i2 in the main ground conductor 22 and a feedback current i3 in the auxiliary ground conductor 24. The feed back currents i2 and i3 flow along the outer edges of the openings 34 and the outer edges of the openings 30, respectively, by a skin effect. In the high-frequency signal transmission line 10*e*, the outer edges of the openings 30 and the outer edges of the openings 34 do not overlap with each other. Accordingly, the position where the feedback current i2 flows and the position where the feedback current i3 flows are separate. Therefore, the coupling between the feedback current i2 and the feedback current i3 is weak, and the current i1 readily flows. Thus, the insertion loss of the high-frequency signal transmission line 10*e* is significantly reduced.

The floating conductors 32 are not indispensable to the high-frequency signal transmission line 10*e*.

High-frequency signal transmission lines according to the present invention are not limited the high-frequency signal transmission lines 10 and 10*a* to 10*e* described above, and various changes and modifications may be possible within the scope of the present invention.

To each of the high-frequency signal transmission lines 10 and 10*a* to 10*e*, the main ground conductor 22 is not indispensable. In a case where the main ground conductor 22 is not provided, the high-frequency signal transmission line is a microstrip transmission line wherein the auxiliary ground conductor 24 serves as a main ground conductor. In order to inhibit electromagnetic wave leakage to the outside, it is preferred that the high-frequency signal transmission lines 10 and 10*a* to 10*e* include the main ground conductor 22.

Further, it is possible to combine the structures of the high-frequency signal transmission lines 10 and 10*a* to 10*e*.

In the preferred embodiments above, the protective layer 14 is preferably formed by screen printing; however, it may be formed by photolithography.

Each of the high-frequency signal transmission lines 10 and 10*a* to 10*e* does not necessarily include the connectors 100*a* and 100*b*. In this case, both ends of the high-frequency signal transmission line 10, 10*a*, 10*b*, 10*c*, 10*d* or 10*e* are connected to circuit boards by solder or the like. Further, each of the high-frequency signal transmission lines 10 and 10*a* to 10*e* may include one connector 100*a* at its one end.

The via-hole conductors may be replaced by through-hole conductors. The through-hole conductors preferably are interlayer conductors formed by making through-holes in the dielectric body 12 and by plating the inner surfaces of the through-holes with a conductive material.

Each of the high-frequency signal transmission lines 10 and 10*a* to 10*e* may be used as a high-frequency signal transmission line in an RF circuit board such as an antenna front-end module or the like, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electronic device comprising:

a casing; and a high-frequency signal transmission line including:

a dielectric body including a plurality of dielectric layers stacked on each other in a stacking direction;

a linear signal line located on or in the dielectric body;

a first ground conductor located at a first side of the signal line in the stacking direction and including a plurality of first openings arranged along the signal line; and a plurality of first floating conductors located at the first side of the signal line in the stacking direction to overlap with the first openings, when viewed from the stacking direction, each of the floating conductors being not connected to any other conductors.

2. The electronic device according to claim 1, wherein the first floating conductors and the first openings are provided on a one-to-one basis.

3. The electronic device according to claim 1, wherein the dielectric body is flexible.

4. The electronic device according to claim 1, wherein the first floating conductors and the first ground conductor are located on the same dielectric layer.

5. The electronic device according to claim 4, wherein each of the first floating conductors is located inside one of the first openings, when viewed from the stacking direction.

6. The electronic device according to claim 1, wherein the first floating conductors are located at the first side of the first ground conductor in the stacking direction.

7. The electronic device according to claim 6, wherein the first floating conductors are the same shape as the first openings, when viewed from the stacking direction.

8. The electronic device according to claim 1, further comprising a second ground conductor located at a second side of the signal line in the stacking direction.

9. The electronic device according to claim 8, wherein the second ground conductor includes a plurality of second openings arranged along the signal line; and the high-frequency signal transmission line further comprises second floating conductors located at the second side of the signal line in the stacking direction to overlap with the second openings, when viewed from the stacking direction, each of the floating conductors being not connected to any other conductors.

10. The electronic device according to claim 9, wherein the first openings have a smaller size than the second openings.

11. A high-frequency signal transmission line comprising:

a dielectric body including a plurality of dielectric layers stacked on each other in a stacking direction;

a linear signal line located in or on the dielectric body;

a first ground conductor located at a first side of the signal line in the stacking direction and including a plurality of first openings arranged along the signal line; and a plurality of first floating conductors located at the first side of the signal line in the stacking direction to overlap with the first openings, when viewed from the stacking direction, each of the floating conductors being not connected to any other conductors.

12. The high-frequency signal transmission line according to claim 11, wherein the first floating conductors and the first openings are provided on a one-to-one basis.

13. The high-frequency signal transmission line according to claim 11, wherein the dielectric body is flexible.

14. The high-frequency signal transmission line according to claim 11, wherein the first floating conductors and the first ground conductor are located on the same dielectric layer.

15. The high-frequency signal transmission line according to claim 14, wherein each of the first floating conductors is located inside one of the first openings, when viewed from the stacking direction.

16. The high-frequency signal transmission line according to claim 11, wherein the first floating conductors are located at the first side of the first ground conductor in the stacking direction.

17. The high-frequency signal transmission line according to claim 16, wherein the first floating conductors are the same shape as the first openings, when viewed from the stacking direction.

18. The high-frequency signal transmission line according to claim 11, further comprising a second ground conductor located at a second side of the signal line in the stacking direction.

19. The high-frequency signal transmission line according to claim 18, wherein the second ground conductor includes a plurality of second openings arranged along the signal line; and the high-frequency signal transmission line further comprises second floating conductors located at the second side of the signal line in the stacking direction to overlap with the second openings, when viewed from the stacking direction, each of the floating conductors being not connected to any other conductors.

20. The high-frequency signal transmission line according to claim 19, wherein the first openings have a smaller size than the second openings.

* * * * *